US012594461B2

(12) United States Patent
Chau et al.

(10) Patent No.: US 12,594,461 B2
(45) Date of Patent: Apr. 7, 2026

(54) USER EXERCISE DETECTION METHOD, ROBOT AND COMPUTER-READABLE STORAGE MEDIUM

(71) Applicant: UBTECH ROBOTICS CORP LTD, Shenzhen (CN)

(72) Inventors: Sheryl Suet Ying Chau, Rancho Cucamonga, CA (US); Robert Malate, Los Angeles, CA (US); Chengkun Zhang, Temple City, CA (US); Huan Tan, Pasadena, CA (US)

(73) Assignee: UBTECH ROBOTICS CORP LTD, Shenzhen (CN)

( * ) Notice: Subject to any disclaimer, the term of this patent is extended or adjusted under 35 U.S.C. 154(b) by 395 days.

(21) Appl. No.: 18/209,425

(22) Filed: Jun. 13, 2023

(65) Prior Publication Data

US 2024/0416177 A1 Dec. 19, 2024

(51) Int. Cl.
*A63B 24/00* (2006.01)

(52) U.S. Cl.
CPC ..... *A63B 24/0062* (2013.01); *A63B 24/0087* (2013.01); *A63B 2024/0093* (2013.01); *A63B 2220/18* (2013.01); *A63B 2220/807* (2013.01); *A63B 2230/62* (2013.01)

(58) Field of Classification Search
CPC ..... A63B 24/0062; A63B 24/0087; A63B 2024/0093; A63B 2220/18; A63B 2220/807; A63B 2230/62; A63B 2220/40; A61B 5/1116
USPC ..... 434/29
See application file for complete search history.

(56) References Cited

U.S. PATENT DOCUMENTS

| | | | | |
|---|---|---|---|---|
| 2015/0258384 | A1* | 9/2015 | Suzuki | A63B 24/0087 482/5 |
| 2022/0023737 | A1* | 1/2022 | Lee | G16H 20/60 |
| 2024/0416177 | A1* | 12/2024 | Chau | A63B 24/0062 |
| 2025/0090906 | A1* | 3/2025 | Yang | A63B 24/0087 |

* cited by examiner

*Primary Examiner* — Pierre E Elisca

(57) ABSTRACT

A user exercise detection method applicable in a robot includes: obtaining first measurement data from at least one inertial measurement unit (IMU) sensor that is arranged at a designated body part of the user, and detecting a posture of the user relative to the robot based on the first measurement data; obtaining second measurement data from the at least one IMU sensor, and determining whether an exercise of the user corresponding to the posture is detected according to a preset threshold parameter and the second measurement data; in response to detection of the exercise, obtaining exercise data when the user performs the exercise multiple times through the at least one IMU sensor; and adjusting the threshold parameter according to the exercise data.

20 Claims, 11 Drawing Sheets

USER EXERCISE DETECTION METHOD, ROBOT AND COMPUTER-READABLE STORAGE MEDIUM

TECHNICAL FIELD

The present disclosure generally relates to sensor-based exercise tracking and detection, and particularly to a user exercise detection method, robot and computer-readable storage medium.

BACKGROUND

There has been continuous research going on in exercise tracking and detection using sensors such as inertial measurement units (IMUs) and camera systems. More recently, researchers have investigated machine learning approaches to solve the exercise detection and tracking problem as the advancement in hardware allows more resource intensive algorithms to be run even in a small sensor (e.g., IMU).

Commercially available products such as smart watches have capabilities to recognize and detect certain exercises or types of exercises. However, the number of exercises that can be recognized is limited. There also exists interactive games to detect the motion or exercises of a user using a camera or IMU sensors. Exercise tracking using a camera system is often performed in a static environment. While some of the machine learning approaches may seem promising, they require a significant amount of data collection and rely on the performance of the users. Current applications and research focus less on the range of motion of the user but more on the ability to detect a particular exercise, lacking the detection of individual users, thus resulting in the lack of data basis for the determination of individual rehabilitation progress.

Therefore, there is a need to provide a user exercise detection method to overcome the above-mentioned problems.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
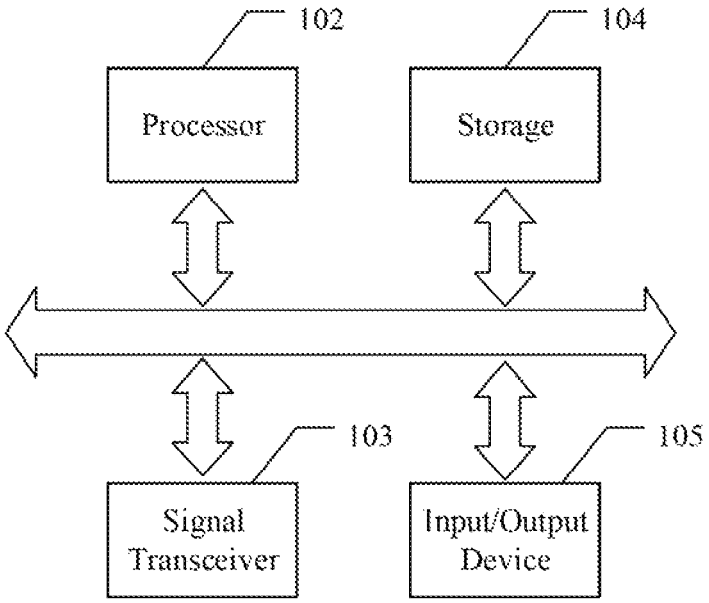
FIG. 1 is a schematic block diagram of a robot according to one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

Figure 2:
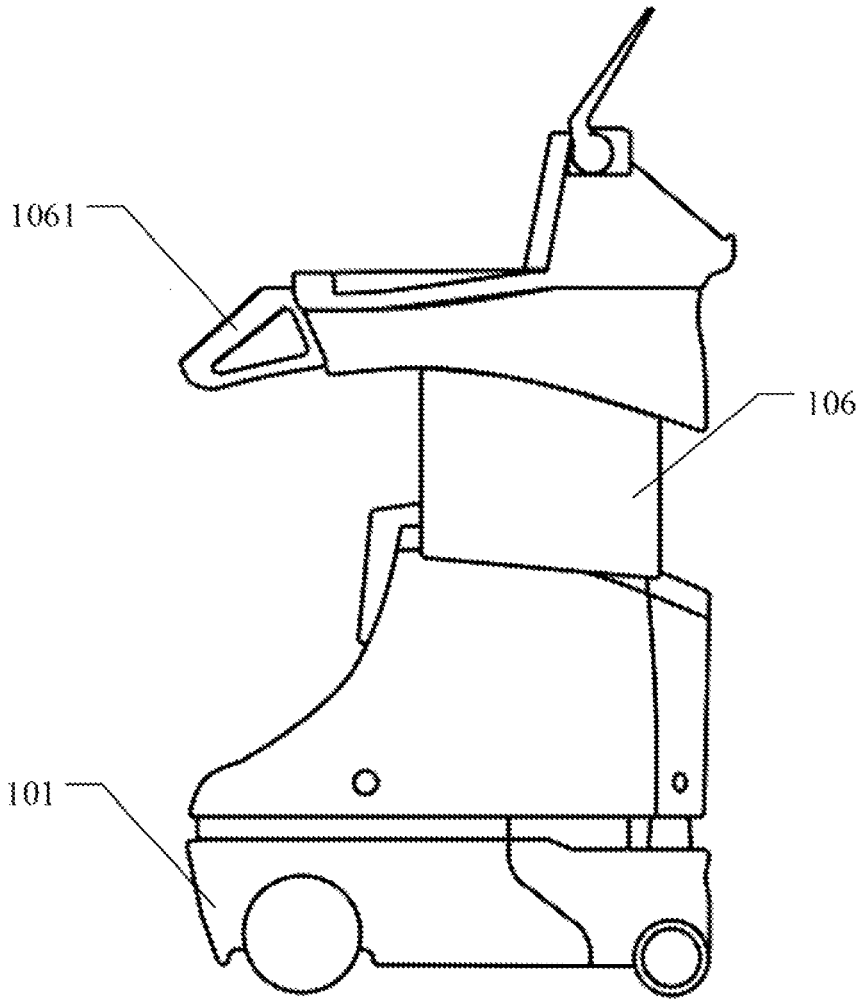
FIG. 2 is an exemplary diagram of the robot according to one embodiment.

FIG. 1 is a schematic block diagram of a robot according to one embodiment. FIG. 2 is an exemplary diagram of the robot according to one embodiment. The robot can assist users in sports and/or rehabilitation training. For example, in an exemplary scenario, a user can hold the robot while standing such that the robot can support part of the user's body weight to reduce the load on the user's legs. The robot can provide a seat that allows a user to sit thereon. The robot can assist a user to walk.

Referring to FIGS. 1 and 2, in one embodiment, the robot may include a wheeled base 101, a processor 102, a signal transceiver 103, a non-transitory storage 104, an input/output device 105, and a main body 106 positioned on the wheeled base 101.

The processor 102 is electrically coupled to the signal transceiver 103, the non-transitory storage 104 and the driving device of the wheeled base 101. The processor 102, the signal transceiver 103 and the non-transitory storage 104 are arranged inside the main body 106.

The signal transceiver 103 can be a wireless signal transceiver that supports wireless communication protocols such as Bluetooth protocol, infrared protocol, near field communication (NFC) protocol, and Wi-Fi protocol. Alternatively, the signal transceiver 103 may be a data transmission line that supports communication protocols such as USB protocol and parallel communication protocol.

The processor 102 can control the robot or the wheeled mobile base 101 based on command instructions received by the signal transceiver 103 or the user's command instructions obtained through a human-computer interaction interface of the input/output device 105. The users may be athletes, healthcare professionals, and paramedics.

The processor 102 may be an integrated circuit chip with signal processing capability. The processor 102 may be a central processing unit (CPU), a general-purpose processor, a digital signal processor (DSP), an application specific integrated circuit (ASIC), a field-programmable gate array (FPGA), a programmable logic device, a discrete gate, a transistor logic device, or a discrete hardware component. The general-purpose processor may be a microprocessor or any conventional processor or the like. The processor 102 can implement or execute the methods, steps, and logical blocks disclosed in the embodiments of the present disclosure.

The storage 104 may be, but not limited to, a random-access memory (RAM), a read only memory (ROM), a programmable read only memory (PROM), an erasable programmable read-only memory (EPROM), and an electrical erasable programmable read-only memory (EEPROM). The storage 104 may be an internal storage unit of the robot, such as a hard disk or a memory. The storage 104 may also be an external storage device of the robot, such as a plug-in hard disk, a smart memory card (SMC), and a secure digital (SD) card, or any suitable flash cards. Furthermore, the storage 104 may also include both an internal storage unit and an external storage device. The storage 104 is to store an operating system, application programs, a boot loader, computer programs, other programs, and data required by the robot, such as program codes of computer programs. The storage 104 can also be used to temporarily store data that have been output or is about to be output.

One or more computer programs that can be executed by the processor 102 are stored on the non-transitory storage 104, and the one or more computer programs may include multiple lines of codes. When the processor 102 executes the computer programs, the steps in the embodiments of the user exercise detection method, such as steps S401 to S404 in FIG. 4, steps S501, S502, and steps S401 to S404 in FIG. 6, and steps S401, S701, S702, and S402 to S404 in FIG. 7 are implemented. Exemplarily, the one or more computer programs may be divided into one or more modules/units, and the one or more modules/units are stored in the storage 104 and executable by the processor 102. The one or more modules/units may be a series of computer program instruction segments capable of performing specific functions, and the instruction segments are used to describe the execution process of the one or more computer programs in the robot.

The main body 106 is located on the top of the wheeled base 101 and arranged vertically. The main body 106 may include at least one handle 1061, and a user may hold the handle 1061 when standing or walking. With the handle 1061, the robot can provide upward support for the user, thereby helping the user maintain balance while standing or walking.

The input/output device 105 can be arranged on the handle 1061. The input/output device 105 may include, but is not limited to: a keyboard, a mouse, a display, and a voice input device.

It should be noted that the diagrams shown in FIGS. 1 and 2 are only an example of the robot. The robot may include more or fewer components than what is shown in FIGS. 1 and 2, or have a different configuration than what is shown in FIGS. 1 and 2. Each component shown in FIG. 1 may be implemented in hardware, software, or a combination thereof.

In one embodiment, the robot may further include an elevation mechanism. The elevation mechanism is arranged on the wheeled base 101 and connected between the wheeled base 101 and the main body 106. The elevation mechanism may include one or more driving motors that are electrically connected to the processor 102. By actuation of the elevation mechanism, the main body is vertically movable up and down between a retracted position and an extended position. In the retracted position, the elevation mechanism enables the robot to have a limited height, which is conducive to the stability of the robot. The elevation mechanism can be actuated to adjust the robot to different heights, flexibly adapting to users of different heights.

In one embodiment, the robot may further include a seat, which is a foldable seat rotatably connected to the main body 106 and disposed above the wheeled base 101. The seat is rotatable between a folded position and an unfolded position. For example, the seat can be driven to rotate by one or more seat motors. The one or more seat motors are electrically connected to the processor 102 and driven by the processor 102 arranged in the main body 106. The processor 102 may receive a command instruction from a user to rotate the seat to the unfolded position so that the user can sit on the seat. The processor 102 may receive a command instruction from the user to rotate the seat back to the folded position so that the robot is ready to be pushed by the user.

In one embodiment, the robot may further include a number of internal or external sensors, such as distance sensors, touch sensors, pressure sensors, inertial measurement unit (IMU) sensors, and camera systems. The internal or external sensors can be used to detect the posture, behavior and exercise of a user. The internal sensors can be arranged on different parts of the robot, such as the handle and/or the seat of the robot.

Figure 3:
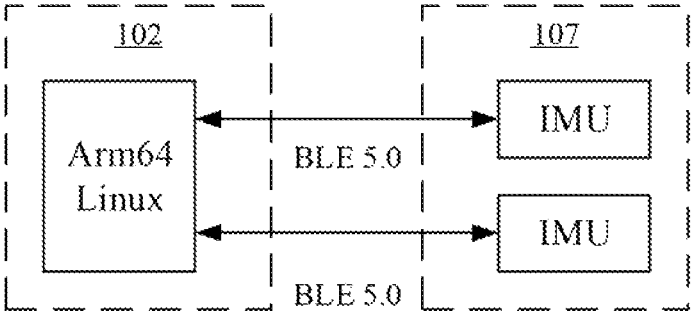
FIG. 3 is a schematic diagram of the internal hardware communication layout of the robot according to one embodiment.

Referring to FIG. 3, in one embodiment, an ARM64-based Linux system can run on the processor 102. The external IMU sensors 107 can be connected and communicated with the ARM64-based Linux system through Bluetooth Low Energy (BLE) 5.0 technology.

Figure 4:
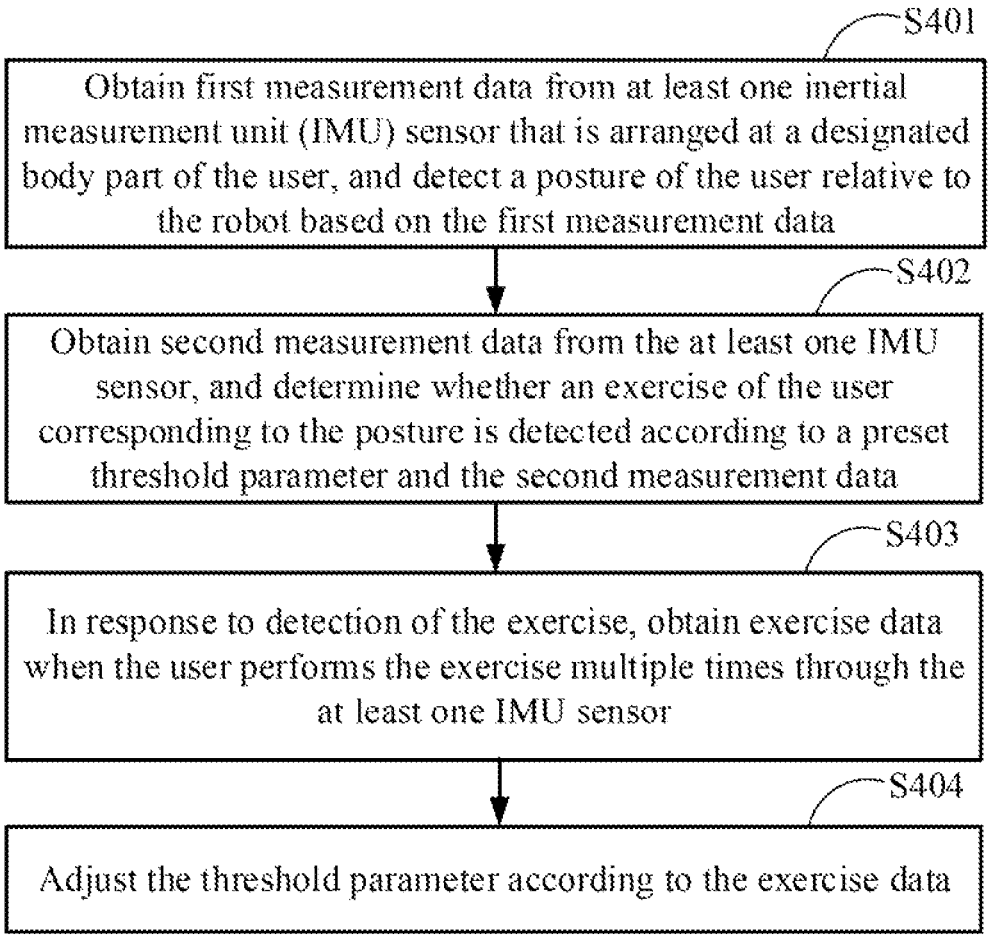
FIG. 4 shows a schematic flowchart of a user exercise detection method according to one embodiment.

FIG. 4 shows a schematic flowchart of a user exercise detection method according to one embodiment. The method may include the following steps.

Step S401: Obtain first measurement data from at least one inertial measurement unit (IMU) sensor that is arranged at a designated body part of the user, and detect a posture of the user relative to the robot based on the first measurement data.

The body parts may be two legs or two arms of the user, and correspond to the user's exercises to be detected. In one embodiment, the IMU sensors can be two in number, and the two IMU sensors can be connected to the processor of the robot via a human-computer interaction interface using Bluetooth.

Figure 5:
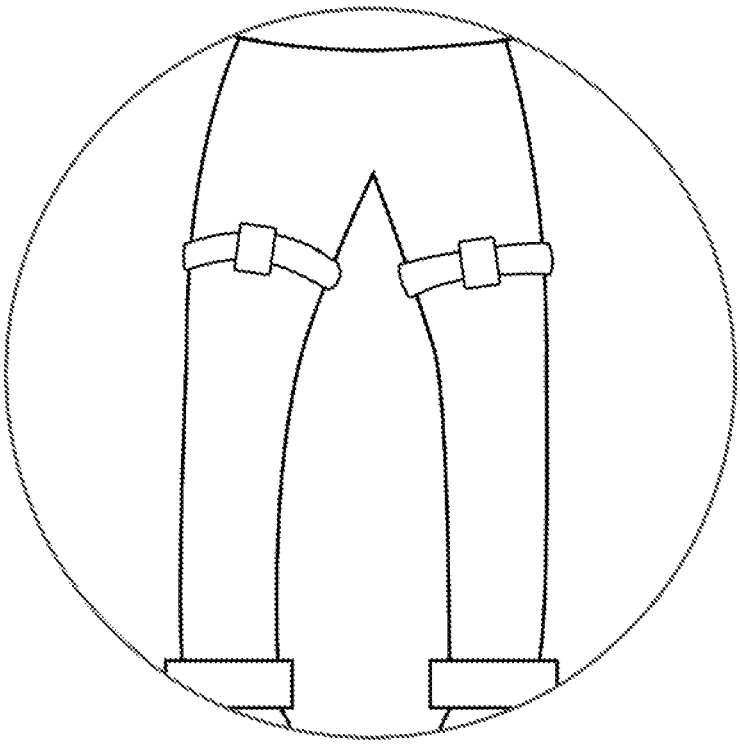
FIG. 5 is a schematic diagram showing two IMU sensors respectively arranged on two legs of a user.

In an example where the body parts are legs of the user, the exercises to be detected can be a series of exercises of the lower body of the user, such as squat exercise and cross-leg exercise. In one embodiment, as shown in FIG. 5, a pair of inertial sensors can be arranged on the two thighs of the user. The first measurement data may include two roll angles, two pitch angles and two yaw angles. The posture of the user relative to the robot may include, but is not limited to, standing and sitting.

Step S402: Obtain second measurement data from the at least one IMU sensor, and determine whether an exercise of the user corresponding to the posture is detected according to a preset threshold parameter and the second measurement data.

In one embodiment, the threshold parameter may include parameters characterizing the range of motion of the thighs of the user. For example, when a user performs a squat exercise, the user is in a standing posture, and the threshold parameter is preset minimum knee flexion angles that need to be achieved when the user performs a squat exercise. If it is detected by the IMU sensors that the flexion angles of the user's knees exceed the threshold parameter, it is determined that the user's exercise corresponding to the posture has been detected.

In another embodiment, when a user performs a cross-leg exercise, the user is in a sitting posture, and the threshold parameter is a preset minimum height difference between a first leg placed over and across the other second leg of the user and the first leg when it is not placed over and across the second leg of the user. If it is detected by the IMU sensors that the difference between a first the two legs of a user that is placed over and across a second of the two legs of the user and the first of the two legs when it is not placed over and across the second of the two legs is greater than the threshold parameter, it is determined that the user's exercise corresponding to the posture has been detected.

In one embodiment, the robot can obtain an exercise selected by the user through the human-computer interaction interface and the threshold parameter corresponding to the exercise.

In one embodiment, when the posture is a standing posture, determining whether the exercise of the user corresponding to the posture is detected according to the preset threshold parameter and the second measurement data may include the following steps: determine whether the flexion angles of the user's knees exceed a preset angle according to a pair of pitch angles measured by two IMU sensors arranged on the user's thighs; and determine that the exercise of the user corresponding to standing posture has been detected in response to the knee flexion angles of the user exceeding the preset angle.

In one embodiment, when the posture is a sitting posture, determining whether the exercise of the user corresponding to the posture is detected according to the preset threshold parameter and the second measurement data may include the following steps: determine whether a lifting height of a leg of the user exceeds a preset height according to a pair of pitch angles measured by two IMU sensors arranged on the user's thighs; and determine that the exercise of the user corresponding to sitting posture has been detected in response to the lifting height of the leg of the user exceeds the preset height.

In one embodiment, if the user cannot complete the exercise corresponding to the posture (e.g., the user cannot perform a squat exercise due to the limited range of motion of the lower limbs), the robot can automatically adjust the preset threshold parameter, repeat step S402 according to the adjusted threshold parameter, and generate an adjustment record. The robot may analyze the user's adjustment record to evaluate the user's rehabilitation effect and output an evaluation result.

Step S403: In response to detection of the exercise, obtain exercise data when the user performs the exercise multiple times through the at least one IMU sensor.

Specifically, the robot may acquire the measurement data from the at least one IMU sensor when the user performs the exercise multiple times, and obtain the exercise data when the user performs the exercise multiple times according to the measurement data. In one embodiment, the exercise data may include range of motion, duration of motion, sets/repetitions and completion rate of the exercise.

Step S404: Adjust the threshold parameter according to the exercise data.

In one embodiment, a training report including the exercise data can be generated according to the acquired exercise data. A processor of the robot can analyze the training report and adjust the preset threshold parameter according to the analysis result, such that the adjusted threshold parameter can be used in subsequent user exercise detection.

In another embodiment, the training report can be uploaded to a cloud server, so that the cloud server can use a machine learning model (e.g., generative artificial intelligence models (GAIM)) to analyze the training report. The cloud serve will send an analysis result to the robot, and the robot can reset the threshold parameter according to the analysis result.

The analysis result may include, for example, whether the aforementioned exercise data such as the range of motion, the duration of motion, sets/repetitions and completion rate of the exercise reach their respective preset minimum completion thresholds. The analysis result may include the rehabilitation degree of the user's exercise ability.

If the minimum thresholds are reached, there is no need to adjust the threshold parameter. If the minimum thresholds are not reached, the threshold parameter in step S402 is reset according to the preset threshold parameter.

In one embodiment, the robot can adjust the threshold parameter according to preset adjustment rules. For example, if each piece of exercise data exceeds its corresponding minimum completion threshold and the difference between each piece of exercise data and its corresponding minimum completion threshold is greater than a preset value, the preset threshold parameter is then adjusted according to a first preset ratio to increase the training intensity. If each piece of exercise data does not exceed its corresponding minimum completion threshold, the preset threshold parameter is adjusted according to a second preset ratio to reduce the training intensity.

By implementing the foregoing method, it can realize the detection of the exercise of a single user, and provide a data basis for the determination of individual rehabilitation progress. By dynamically adjusting the preset threshold parameter according to the user's exercise data, the accuracy of exercise detection can be improved, making the user's exercise detection more targeted, thereby improving the training effect.

In another embodiment, when the exercise is not detected, return to the step of obtaining the second measurement data from the at least one IMU sensor. Then, the number of times the exercise is not detected is counted. A first prompt message is output through the human-computer interaction interface of the robot when the counted number reaches a preset number. The first prompt message is to prompt the user to modify the threshold parameter. The threshold parameter is then modified based on the user's operation on the human-computer interaction interface.

Specifically, if the user's exercise corresponding to the posture is not detected, step S302 will be repeated until the exercise is detected. Alternatively, when the repeated detection reaches a preset number of times, and the corresponding user's exercise has not been detected, it is determined that the user cannot perform the corresponding exercise. Then, the first prompt message is output to prompt the user to modify the preset threshold parameter. The content of the first prompt message may be, for example, "No user exercise is detected. Try reducing the threshold parameter." A user can adjust the threshold parameter through the human-computer interaction interface according to the prompt. The robot may modify the value of the preset threshold parameter to the value input by the user through the human-computer interaction interface, such as the value input by the user on the GUI interface on a touch screen, so as to reduce the difficulty of training. After the threshold parameter is modified, if the number of times the user's exercise is not detected reaches the preset number again, the user is prompted again to modify the threshold parameter until the exercise of the user is detected.

Figure 6:
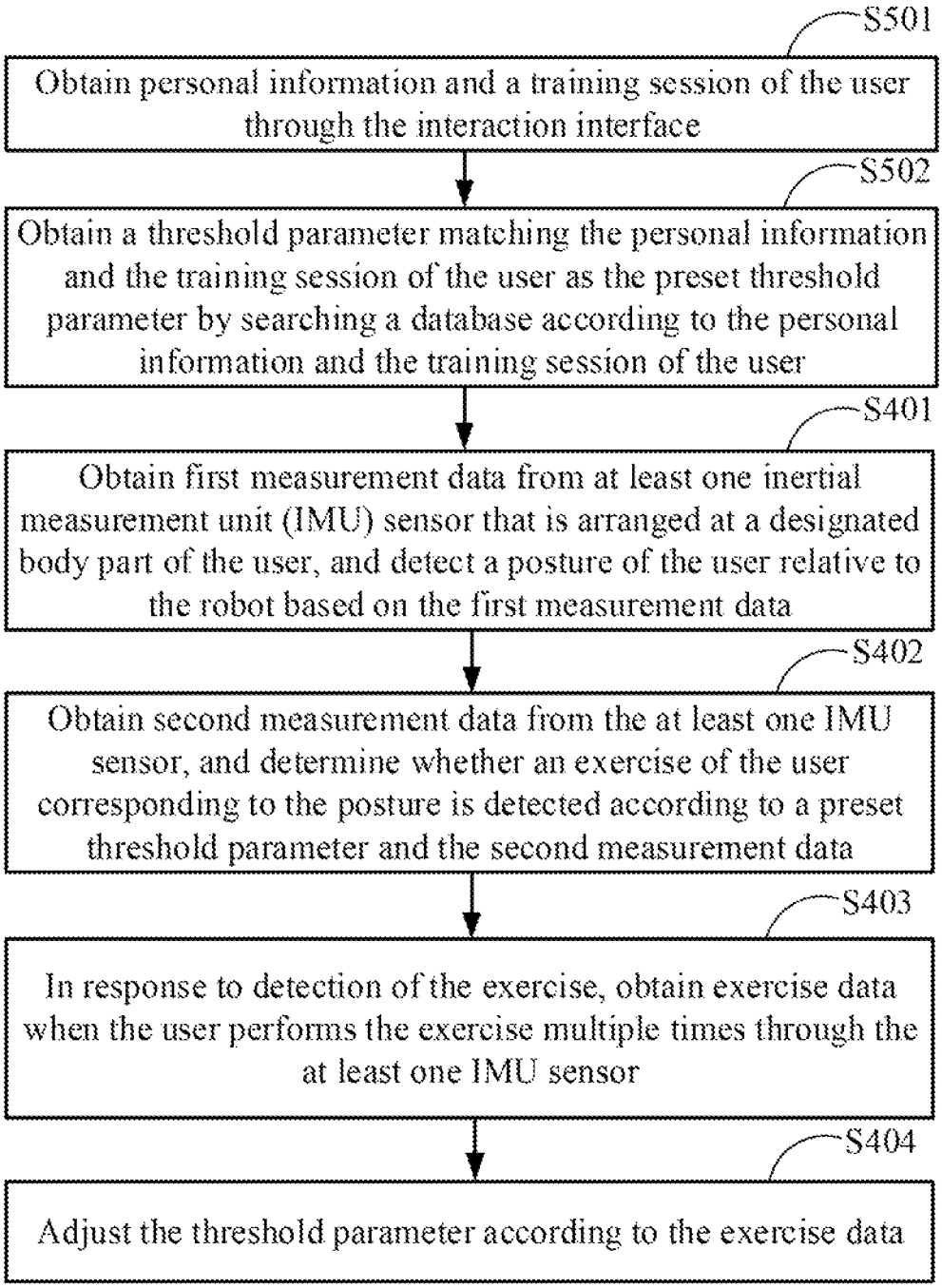
FIG. 6 shows a schematic flowchart of a user exercise detection method according to another embodiment.
Figure 7:
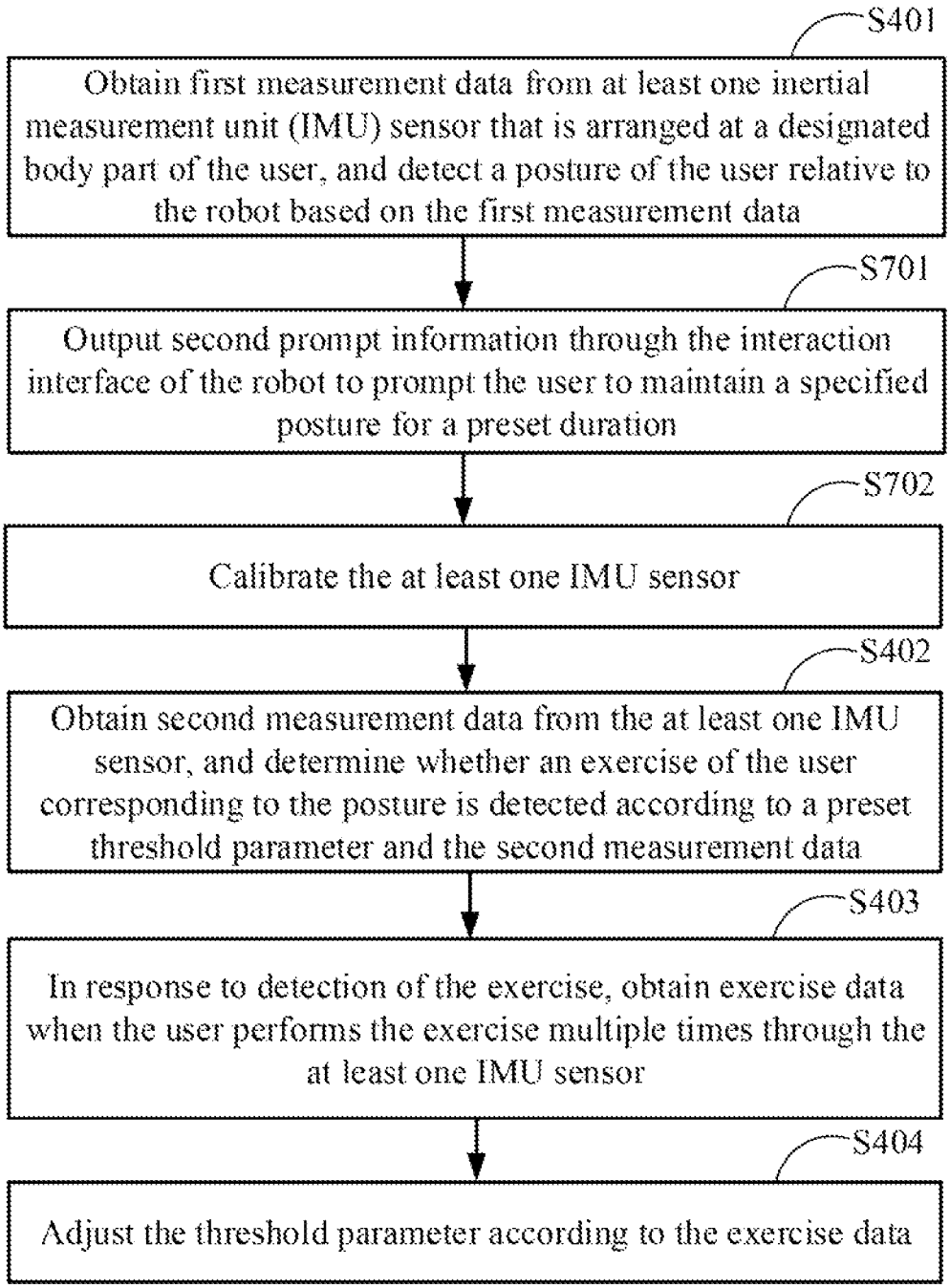
FIG. 7 shows a schematic flowchart of a user exercise detection method according to another embodiment.

In one embodiment, the robot can generate a parameter adjustment record after the detection of the user's exercise is completed, so as to analyze the user's rehabilitation situation according to the parameter adjustment record and historical parameter adjustment records, FIG. 6 is an exemplary flowchart of a user exercise detection method according to another embodiment. Different from the embodiment shown in FIG. 4, the method shown in FIG. 6 may further include the following steps before step S401.

Step S501: Obtain personal information and a training session of the user through the interaction interface.

Step S502: Obtain a threshold parameter matching the personal information and the training session of the user as the preset threshold parameter by searching a database according to the personal information and the training session of the user.

Specifically, different training sessions can be customized for each user, and different training sessions can be used for different rehabilitation purposes or rehabilitation plans, and each training session can be associated with at least one exercise. For example, the squat exercise and cross-leg exercise are intended for a gluteal muscle contracture release rehabilitation program, which corresponds to a lower body training session.

A database may be configured in the robot, and the database stores corresponding relationship between multiple threshold parameters, multiple training sessions, and multiple pieces of personal information. Alternatively, the database can be configured on a cloud server.

Before user exercise detection, the robot can obtain the personal information and a training session of the user to be monitored through the human-computer interaction interface on the robot, and then search the database on a local or cloud server, so as to obtain the threshold parameter matching the personal information and the training session as preset threshold parameter. The personal information may include at least one identification information of the user. Optionally, the personal information may further include the user's gender, age, disease information and rehabilitation information.

In one embodiment, the robot may generate a training report according to the personal information and the training session of the user, the threshold parameter and the exercise data, and send the training report to a cloud server for analysis. The robot may obtain an analysis result output by the cloud server, and adjust the threshold parameter according to the analysis result. The training report may include the personal information, the training session, the preset threshold parameter and the exercise data of the user corresponding to the user exercise detection, so as to allow the cloud server to analyze the exercise data based on the user's personal information, the training session and the threshold parameter.

By using the database like this, based on the user's operation on the GUI interface, personalized training sessions can be customized for different users, so that according to the different characteristics of each user, the corresponding threshold parameters can be automatically matched to assist the users in the exercise test. In this way, more targeted user exercise detection can be achieved. The method described in the embodiments above can add new customization functions for individual users, so that healthcare professionals can monitor the rehabilitation progress and health status of specific users, and provide relevant users with personalized plans and data analysis to realize the assessment and monitoring of the health status of specific users.

In one embodiment, the robot can obtain the number of sensors selected by the user and the positions of the sensors through the human-computer interaction interface of the robot. The training sessions are determined according to the number of sensors and the positions of the sensors.

In one embodiment, the robot can obtain the positions of the IMU sensors selected by the user through the human-computer interaction interface. The training sessions are determined according to the number of the IMU sensors connected to the robot and the positions of the IMU sensors selected by the user.

In one embodiment, posture calibration can be performed using a camera system on the robot after step S401.

Specifically, the database may store feature data of reference postures corresponding to each training session. Depending on the type of the exercises, the reference postures may vary. For example, squat exercise detection requires a standing posture, and cross-leg exercise detection requires a sitting posture.

In one embodiment, the method may further include the following steps between step S401 and S402.

Step S601: Obtain feature data of a reference posture.

In one embodiment, the characteristic data of the reference posture can be obtained by searching the database according to the user's personal information and/or training session corresponding to the reference posture.

Step S602: Capture one or more pictures of the user through a camera system on the robot, and extract feature data of the posture based on the one or more pictures.

Step S603: Compare the extracted feature data with the feature data of the reference postures to obtain a similarity between the extracted feature data and the feature data of the reference posture.

Step S604: In response to the similarity greater than a preset value, execute step S402 or the following step S701.

Step S604: In response to the similarity not greater than the preset value, output third prompt information through the interaction interface to prompt the user to adjust the posture and return to step S602.

By executing steps S601 to S605 to perform posture calibration before user exercise detection, the accuracy of exercise detection can be further improved.

In another embodiment, the robot can adjust control parameters of the robot according to the obtained exercise data, and control the robot according to the adjusted control parameters. The control parameters may include at least one of a movement speed, the height of the handle and the height of the seat. For example, when a walking assistance task is performed, the movement of the robot is controlled according to the adjusted movement speed. In another example, when it is detected by a proximity sensor or pressure sensor or touch sensor that the user is holding the handle of the robot, or that the user is sitting on the seat of the robot, the robot is controlled to move the handle or the seat to a position at an adjusted height.

FIG. 7 is an exemplary flowchart of a user exercise detection method according to another embodiment. Different from the embodiment shown in FIG. 4, the method shown in FIG. 7 may further include the following steps before step S402.

Step S701: Output second prompt information through the interaction interface of the robot to prompt the user to maintain a specified posture for a preset duration.

Step S702: Calibrate the at least one IMU sensor.

Specifically, according to the characteristics of the exercises, different calibration durations and corresponding specified postures can be preset for different training sessions or exercises for IMU calibration. For example, for the standing exercise, the corresponding designated posture is squat, and the user is required to stand still for 2 seconds for the calibration of the IMU sensors. For the cross-leg exercise, the corresponding designated posture is a sitting posture, and the user is required to remain still for 3 seconds for the calibration of the IMU sensors.

In another embodiment, the robot can determine the calibration duration and the corresponding designated posture according to the training session obtained in step S501.

Figure 8:
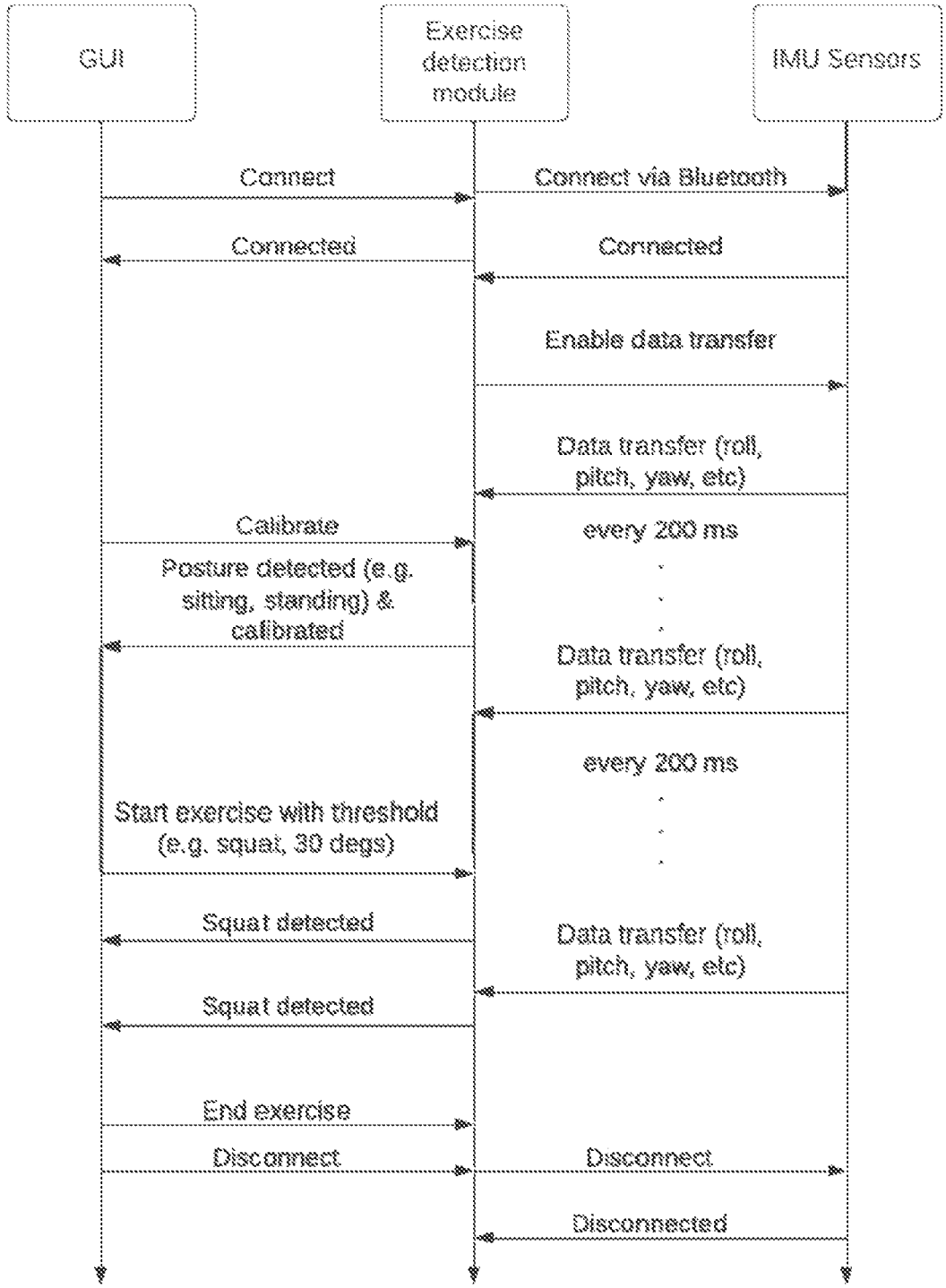
FIG. 8 is an interactive workflow diagram of a user exercise detection method according to one embodiment.
Figure 9:
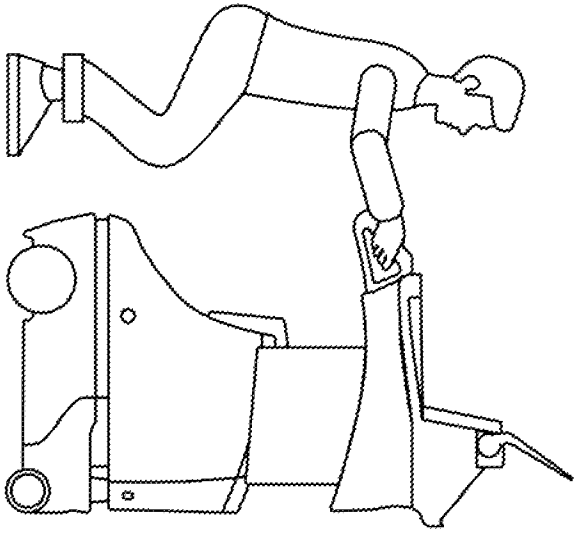
FIG. 9 is a schematic diagram of a user performing a squat exercise (standing posture) beside the robot.
Figure 10:
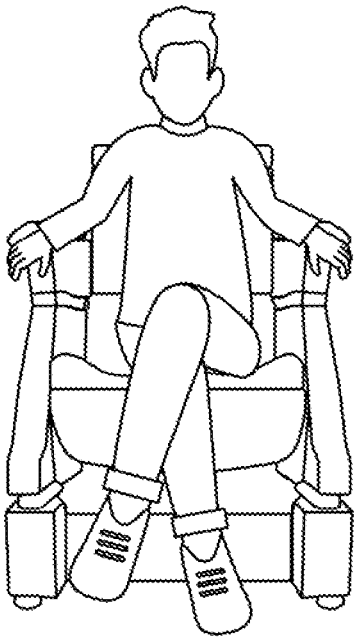
FIG. 10 is a schematic diagram of a user sitting on the seat of the robot and performing a cross-leg exercise.

FIG. 8 is an interactive workflow diagram of a user exercise detection method according to one embodiment. FIG. 9 is a schematic diagram of a user performing a squat exercise (standing posture) beside the robot. FIG. 10 is a schematic diagram of a user sitting on the seat of the robot and performing a cross-leg exercise.

In the user exercise detection method described in the embodiments above, each type of exercise has a corresponding variant of the detection algorithm. On the basis of a basic algorithm, different variants use a combination of different measured values from the IMU sensors based on the complexity of the exercises. This means that detection can be customized to the user's physical capabilities through threshold parameters.

Taking FIGS. 9 and 10 as an example, based on a pair of pitch angles from the IMU sensors, the detection algorithm can determine whether an exercise corresponding to the pitch angles is detected. Then, the user's range of motion can be determined based on the user's exercise data measured by the IMU sensors when the user performs the corresponding exercise multiple times in succession.

As shown in FIG. 8, on the one hand, the exercise detection module running on the processor of the robot establishes a data connection with the GUI interface, obtains personal information and a training session input by the user through the GUI interface, and determines corresponding threshold parameters according to the personal information and training session.

On the other hand, the exercise detection module establishes a data connection with the IMU sensors via Bluetooth and enables data transmission. The IMU sensors transmit measurement data (such as roll angles, pitch angles, yaw angles, etc.) to the exercise detection module every preset time period (such as every 200 milliseconds), so that the exercise detection module can detect the posture of the user relative to the robot based on the measurement data transmitted by the IMU sensors, and determine whether the user's exercise (e.g., squatting) corresponding to the user's posture (e.g., whether the user's knee flexion angles exceed 30 degrees) is detected. When the exercise is detected, according to the measurement data transmitted by the IMU sensors, the exercise data when the user performs the exercise multiple times is obtained.

In the process of user exercise detection, the exercise detection module outputs corresponding prompt information at different stages of exercise detection through the human-computer interaction interface of the robot to guide the user to perform different exercises, and controls the detection process based on the user's operation on the GUI interface of the human-computer interaction interface, such as IMU sensor calibration, starting exercise, squat detection, and ending exercise.

Figure 11:
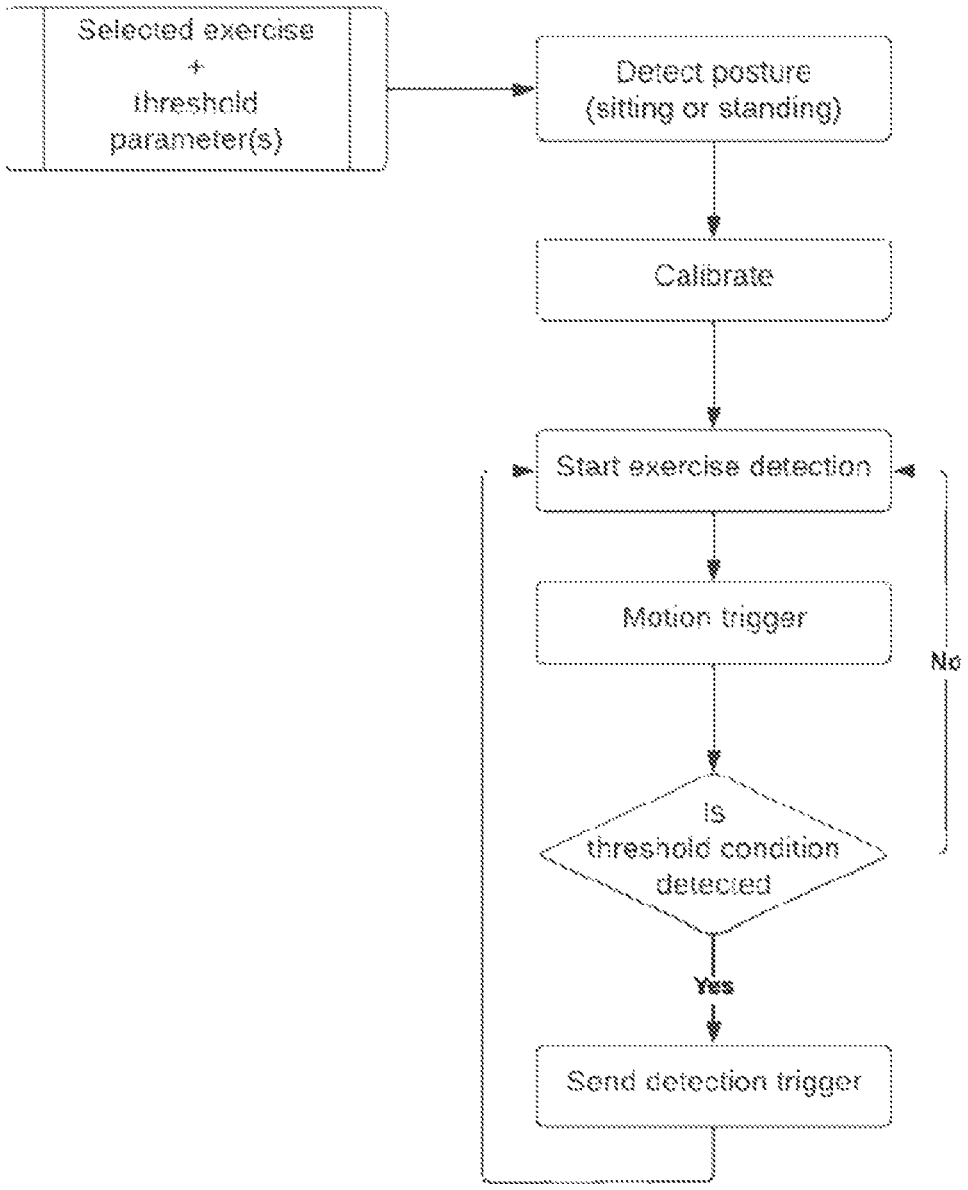
FIG. 11 shows a schematic flowchart of a user exercise detection method according to another embodiment.

To help understand the process of user exercise detection, please take FIG. 11 as an example. As shown in FIG. 11, the robot may first select an exercise and predefined threshold parameters corresponding to the exercise, and feed the corresponding predefined threshold parameters to the algorithm. These threshold parameters may be predefined for users in the cloud database.

Then, the robot detects the user's posture (sitting or standing) based on the measurement data continuously transmitted by the IMU sensors, followed by IMU calibration. After calibration is complete, the robot will start exercise detection. If the movement of the user is detected based on the measurement data continuously transmitted by the IMU sensors, exercise detection is triggered. Based on the threshold parameters and the measurement data continuously transmitted by the IMU sensors, it is determined whether a threshold condition is detected, that is, whether an exercise corresponding to the posture of the user is detected. For example, when a user performs a squat exercise, exercise detection is triggered if the flexion angles of the knees of a user exceed a preset angle. In the case of cross-leg exercise, when the user is sitting, if the user lifts the right or left leg to position of a preset height, exercise detection will be triggered. If an exercise is detected based on the predefined threshold parameter, a trigger detection signal is sent to start obtaining exercise data when the user performs the exercise multiple times. When a stop command is received, exercise detection ends.

It should be noted that content such as information exchange between the modules/units and the execution processes thereof is based on the same idea as the method embodiments of the present disclosure, and produces the same technical effects as the method embodiments of the present disclosure. For the specific content, refer to the foregoing description in the method embodiments of the present disclosure. Details are not repeated herein.

Another aspect of the present disclosure is directed to a non-transitory computer-readable medium storing instructions which, when executed, cause one or more processors to perform the methods, as discussed above. The computer-readable medium may include volatile or non-volatile, magnetic, semiconductor, tape, optical, removable, non-removable, or other types of computer-readable medium or computer-readable storage devices. For example, the computer-readable medium may be the storage device or the memory module having the computer instructions stored thereon, as disclosed. In some embodiments, the computer-readable medium may be a disc or a flash drive having the computer instructions stored thereon. The non-transitory computer-readable medium may be the storage 104 in the robot as shown in FIG. 1.

It should be understood that the disclosed device and method can also be implemented in other manners. The device embodiments described above are merely illustrative. For example, the flowcharts and block diagrams in the accompanying drawings illustrate the architecture, functionality and operation of possible implementations of the device, method and computer program product according to embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In addition, functional modules in the embodiments of the present disclosure may be integrated into one independent part, or each of the modules may be independent, or two or more modules may be integrated into one independent part. in addition, functional modules in the embodiments of the present disclosure may be integrated into one independent part, or each of the modules may exist alone, or two or more modules may be integrated into one independent part. When the functions are implemented in the form of a software functional unit and sold or used as an independent product, the functions may be stored in a computer-readable storage medium. Based on such an understanding, the technical solutions in the present disclosure essentially, or the part contributing to the prior art, or some of the technical solutions may be implemented in a form of a software product. The computer software product is stored in a storage medium and includes several instructions for instructing a computer device (which may be a personal computer, a server, a network device, or the like) to perform all or some of the steps of the methods described in the embodiments of the present disclosure. The foregoing storage medium includes: any medium that can store program code, such as a USB flash drive, a removable hard disk, a read-only memory (ROM), a random access memory (RAM), a magnetic disk, or an optical disc.

A person skilled in the art can clearly understand that for the purpose of convenient and brief description, for specific working processes of the device, modules and units described above, reference may be made to corresponding processes in the embodiments of the foregoing method, which are not repeated herein.

In the embodiments above, the description of each embodiment has its own emphasis. For parts that are not detailed or described in one embodiment, reference may be made to related descriptions of other embodiments.

A person having ordinary skill in the art may clearly understand that, for the convenience and simplicity of description, the division of the above-mentioned functional units and modules is merely an example for illustration. In actual applications, the above-mentioned functions may be allocated to be performed by different functional units according to requirements, that is, the internal structure of the device may be divided into different functional units or modules to complete all or part of the above-mentioned functions. The functional units and modules in the embodiments may be integrated in one processing unit, or each unit may exist alone physically, or two or more units may be integrated in one unit. The above-mentioned integrated unit may be implemented in the form of hardware or in the form of software functional unit. In addition, the specific name of each functional unit and module is merely for the convenience of distinguishing each other and are not intended to limit the scope of protection of the present disclosure. For the specific operation process of the units and modules in the above-mentioned system, reference may be made to the corresponding processes in the above-mentioned method embodiments, and are not described herein.

A person having ordinary skill in the art may clearly understand that, the exemplificative units and steps described in the embodiments disclosed herein may be implemented through electronic hardware or a combination of computer software and electronic hardware. Whether these functions are implemented through hardware or software depends on the specific application and design constraints of the technical schemes. Those ordinary skilled in the art may implement the described functions in different manners for each particular application, while such implementation should not be considered as beyond the scope of the present disclosure.

In the embodiments provided by the present disclosure, it should be understood that the disclosed apparatus (device)/terminal device and method may be implemented in other manners. For example, the above-mentioned apparatus (device)/terminal device embodiment is merely exemplary. For example, the division of modules or units is merely a logical functional division, and other division manner may be used in actual implementations, that is, multiple units or components may be combined or be integrated into another system, or some of the features may be ignored or not performed. In addition, the shown or discussed mutual coupling may be direct coupling or communication connection, and may also be indirect coupling or communication connection through some interfaces, devices or units, and may also be electrical, mechanical or other forms.

The units described as separate parts may or may not be physically separate, and parts displayed as units may or may not be physical units, may be located in one position, or may be distributed on a plurality of network units. Some or all of the modules may be selected according to actual requirements to achieve the objectives of the solutions of the embodiments.

The functional units and modules in the embodiments may be integrated in one processing unit, or each unit may exist alone physically, or two or more units may be integrated in one unit. The above-mentioned integrated unit may be implemented in the form of hardware or in the form of software functional unit.

When the integrated module/unit is implemented in the form of a software functional unit and is sold or used as an independent product, the integrated module/unit may be stored in a non-transitory computer-readable storage medium. Based on this understanding, all or part of the processes in the method for implementing the above-mentioned embodiments of the present disclosure may also be implemented by instructing relevant hardware through a computer program. The computer program may be stored in a non-transitory computer-readable storage medium, which may implement the steps of each of the above-mentioned method embodiments when executed by a processor. In which, the computer program includes computer program codes which may be the form of source codes, object codes, executable files, certain intermediate, and the like. The computer-readable medium may include any primitive or device capable of carrying the computer program codes, a recording medium, a USB flash drive, a portable hard disk, a magnetic disk, an optical disk, a computer memory, a read-only memory (ROM), a random-access memory (RAM), electric carrier signals, telecommunication signals and software distribution media. It should be noted that the content contained in the computer readable medium may be appropriately increased or decreased according to the requirements of legislation and patent practice in the jurisdiction. For example, in some jurisdictions, according to the legislation and patent practice, a computer readable medium does not include electric carrier signals and telecommunication signals.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A computer-implemented user exercise detection method applicable in a robot, the method comprising:

providing the robot comprises: a processor, and at least one inertial measurement unit (IMU) sensor arranged at a designated body part of a user;

obtaining, through the at least one IMU sensor, first measurement data, and detecting, through the processor, a posture of the user relative to the robot based on the first measurement data;

obtaining, through the at least one IMU sensor, second measurement data, and determining, through the processor, whether an exercise of the user corresponding to the posture is detected according to a preset threshold parameter and the second measurement data;

in response to detection of the exercise, obtaining exercise data when the user performs the exercise multiple times through the at least one IMU sensor; and adjusting, through the processor, control parameters of the robot and the threshold parameter according to the exercise data, and controlling the robot according to the adjusted control parameters.

2. The method of claim 1, further comprising, after determining whether the exercise of the user corresponding to the posture is detected according to the preset threshold parameter and the second measurement data, in response to no detection of the exercise, repeating obtaining the second measurement data from the at least one IMU sensor;

in response to an amount of times of the exercise not being detected reaching a preset value, outputting a first prompt message through an interaction interface of the robot to prompt the user to modify the threshold parameter; and modifying the threshold parameter based on an input from the user through the interaction interface.

3. The method of claim 2, further comprising, before obtaining the second measurement data from the at least one IMU sensor, obtaining personal information and a training session of the user through the interaction interface; and obtaining a threshold parameter matching the personal information and the training session of the user as the preset threshold parameter by searching a database according to the personal information and the training session of the user.

4. The method of claim 3, further comprising:

generating a training report according to the personal information and the training session of the user, the threshold parameter and the exercise data, and sending the training report to a cloud server for analysis; and obtaining an analysis result output by the cloud server, and adjusting the threshold parameter according to the analysis result.

5. The method of claim 1, wherein the at least one IMU sensor is two in number, the two IMU sensors are respectively arranged on two legs of the user, and the first measurement data comprises two roll angles, two pitch angles and two yaw angles.

6. The method of claim 5, wherein the posture is a standing posture, and the second measurement data is the two pitch angles; determining whether the exercise of the user corresponding to the posture is detected according to the preset threshold parameter and the second measurement data comprises:

determining whether knee flexion angles of the user exceed a preset threshold according to the two pitch angles; and in response to the knee flexion angles of the user exceeding the preset threshold, determining that the exercise of the user corresponding to standing posture has been detected.

7. The method of claim 5, wherein the posture is a sitting posture, and the second measurement data is the two pitch angles; determining whether the exercise of the user corresponding to the posture is detected according to the preset threshold parameter and the second measurement data comprises:

determining whether a lifting height of a leg of the user exceeds a preset threshold according to the two pitch angles; and in response to the lifting height of the leg of the user exceeds the preset threshold, determining that the exercise of the user corresponding to sitting posture has been detected.

8. The method of claim 1, wherein the exercise data comprises a range of motion, a duration of the exercise, and sets/repetitions and a completion rate of the exercise;

wherein the robot further comprises: a wheeled base, a seat, and a main body positioned on the wheeled base, the seat is connected to the main body and disposed above the wheeled base, and the main body comprises at least one handle; and wherein the control parameters comprise at least one of a movement speed, a height of the at least one handle, and a height of the seat.

9. The method of claim 1, further comprising, before obtaining the second measurement data from the at least one IMU sensor, and determining whether the exercise of the user corresponding to the posture is detected according to the preset threshold parameter and the second measurement data, outputting second prompt information through an interaction interface of the robot to prompt the user to maintain a specified posture for a preset duration; and calibrating the at least one IMU sensor.

10. The method of claim 9, further comprising, after obtaining the first measurement data from the at least one IMU sensor, and detecting the posture of the user relative to the robot based on the first measurement data, a) obtaining feature data of a reference posture;

b) capturing one or more pictures of the user through a camera system on the robot, and extracting feature data of the posture based on the one or more pictures;

c) comparing the extracted feature data with the feature data of the reference posture to obtain a similarity between the extracted feature data and the feature data of the reference posture; and d) in response to the similarity not greater than a preset value, outputting third prompt information through the interaction interface to prompt the user to adjust the posture, and returning to step b).

11. A robot comprising:

at least one inertial measurement unit (IMU) sensor arranged at a designated body part of a user;

one or more processors; and a memory coupled to the one or more processors, the memory storing programs that, when executed by the one or more processors, cause performance of operations comprising:

obtaining first measurement data through the at least one IMU sensor, and detecting a posture of the user relative to the robot based on the first measurement data;

obtaining second measurement data through the at least one IMU sensor, and determining whether an exercise of the user corresponding to the posture is detected according to a preset threshold parameter and the second measurement data;

in response to detection of the exercise, obtaining exercise data when the user performs the exercise multiple times through the at least one IMU sensor; and adjusting control parameters of the robot and the threshold parameter according to the exercise data, and controlling the robot according to the adjusted control parameters.

12. The robot of claim 11, wherein the operations further comprise, after determining whether the exercise of the user corresponding to the posture is detected according to the preset threshold parameter and the second measurement data, in response to no detection of the exercise, repeating obtaining the second measurement data from the at least one IMU sensor;

in response to an amount of times of the exercise not being detected reaching a preset value, outputting a first prompt message through an interaction interface of the robot to prompt the user to modify the threshold parameter; and modifying the threshold parameter based on an input from the user through the interaction interface.

13. The robot of claim 12, wherein the operations further comprise, before obtaining the second measurement data from the at least one IMU sensor, obtaining personal information and a training session of the user through the interaction interface; and obtaining a threshold parameter matching the personal information and the training session of the user as the preset threshold parameter by searching a database according to the personal information and the training session of the user.

14. The robot of claim 13, wherein the operations further comprise:

generating a training report according to the personal information and the training session of the user, the threshold parameter and the exercise data, and sending the training report to a cloud server for analysis; and obtaining an analysis result output by the cloud server, and adjusting the threshold parameter according to the analysis result.

15. The robot of claim 11, wherein the at least one IMU sensor is two in number, the two IMU sensors are respectively arranged on two legs of the user, and the first measurement data comprises two roll angles, two pitch angles and two yaw angles.

16. The robot of claim 15, wherein the posture is a standing posture, and the second measurement data is the two pitch angles; determining whether the exercise of the user corresponding to the posture is detected according to the preset threshold parameter and the second measurement data comprises:

determining whether knee flexion angles of the user exceed a preset threshold according to the two pitch angles; and in response to the knee flexion angles of the user exceeding the preset threshold, determining that the exercise of the user corresponding to standing posture has been detected.

17. The robot of claim 15, wherein the posture is a sitting posture, and the second measurement data is the two pitch angles; determining whether the exercise of the user corresponding to the posture is detected according to the preset threshold parameter and the second measurement data comprises:

determining whether a lifting height of a leg of the user exceeds a preset threshold according to the two pitch angles; and in response to the lifting height of the leg of the user exceeds the preset threshold, determining that the exercise of the user corresponding to sitting posture has been detected.

18. The robot of claim 11, wherein the exercise data comprises a range of motion, a duration of the exercise, and sets/repetitions and a completion rate of the exercise.

19. The robot of claim 11, wherein the operations further comprise, before obtaining the second measurement data from the at least one IMU sensor, and determining whether the exercise of the user corresponding to the posture is detected according to the preset threshold parameter and the second measurement data, outputting second prompt information through an interaction interface of the robot to prompt the user to maintain a specified posture for a preset duration; and calibrating the at least one IMU sensor.

20. A non-transitory computer-readable storage medium storing instructions that, when executed by at least one processor of a robot, cause the at least one processor to perform a method, the method comprising:

obtaining first measurement data from at least one inertial measurement unit (IMU) sensor that is arranged at a designated body part of the user, and detecting a posture of the user relative to the robot based on the first measurement data;

obtaining second measurement data from the at least one IMU sensor, and determining whether an exercise of the user corresponding to the posture is detected according to a preset threshold parameter and the second measurement data;

in response to detection of the exercise, obtaining exercise data when the user performs the exercise multiple times through the at least one IMU sensor; and adjusting control parameters of the robot and the threshold parameter according to the exercise data, and controlling the robot according to the adjusted control parameters.

* * * * *